US008572930B2

(12) United States Patent
Platt

(10) Patent No.: US 8,572,930 B2
(45) **Date of Patent: *Nov. 5, 2013**

(54) SINGLE LAYERED WEB BEAM FOR A DRYWALL SUSPENDED CEILING

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 248 days.

This patent is subject to a terminal disclaimer.

(21) Appl. No.: 11/481,374

(22) Filed: Jul. 5, 2006

(65) Prior Publication Data

US 2007/0277467 A1 Dec. 6, 2007

Related U.S. Application Data

(63) Continuation-in-part of application No. 11/446,729, filed on Jun. 5, 2006.

(51) Int. Cl.
*E04C 3/04* (2006.01)
*B21D 47/00* (2006.01)

(52) U.S. Cl.
USPC ..... 52/842; 29/897.35

(58) Field of Classification Search
USPC ..... 52/506.07, 729.5, 730.6, 731.7, 733.1, 52/836, 846, 842; 29/897.35
See application file for complete search history.

(56) References Cited

U.S. PATENT DOCUMENTS 1,826,133 A * 10/1931 Hatch ..... 52/772
2,065,378 A * 12/1936 Kling ..... 52/729.5
2,092,210 A * 9/1937 Greulich ..... 52/729.2
2,108,373 A * 2/1938 Greulich ..... 52/729.5
3,270,479 A 9/1966 Weinar
3,283,467 A 11/1966 Znamirowski
3,284,977 A 11/1966 Lickliter et al.
3,290,075 A 12/1966 Jahn
3,292,332 A 12/1966 Jahn
3,319,389 A 5/1967 Levine
3,340,662 A 9/1967 Deinhart et al.
3,342,515 A 9/1967 Jahn
3,356,402 A 12/1967 Smith
3,645,051 A 2/1972 Kolesar
3,675,957 A 7/1972 Lickliter et al.
3,746,379 A 7/1973 Sauer
3,778,947 A 12/1973 Sauer
3,898,784 A 8/1975 Sauer et al.

(Continued)

FOREIGN PATENT DOCUMENTS

EP 0 205 673 A1 12/1986

OTHER PUBLICATIONS

European Search Report (A3 Publication) Issued by European Patent Office in European Patent Application No. 07013143.8. The European Search was Completed Apr. 2, 2009, and The Publication date was May 13, 2009.

(Continued)

*Primary Examiner* — James Buckle, Jr.
(74) *Attorney, Agent, or Firm* — Eugene Chovanes

(57) ABSTRACT

A balanced, single-layered web beam for a grid in a drywall suspended ceiling, wherein opposing flanges at the bottom of the web are cantilevered directly from the bottom of the web. When the flanges are equally loaded by the drywall sheets, the resultant load on the beam passes through the vertical plane of the web, so the beam does not twist or bend.

3 Claims, 5 Drawing Sheets

(56) References Cited

U.S. PATENT DOCUMENTS

| | | | | | |
|---|---|---|---|---|---|
| 3,903,671 | A | | 9/1975 | Cuin et al. | |
| 3,921,346 | A | | 11/1975 | Sauer et al. | |
| 4,019,300 | A | | 4/1977 | Sauer et al. | |
| 4,041,668 | A | | 8/1977 | Jahn et al. | |
| 4,064,671 | A | | 12/1977 | Sauer | |
| 4,084,364 | A | | 4/1978 | Jones | |
| RE31,528 | E | | 3/1984 | Mieyal | |
| 4,489,529 | A | * | 12/1984 | Ollinger et al. | 52/731.7 |
| 4,492,066 | A | | 1/1985 | LaLonde | |
| 4,520,609 | A | | 6/1985 | Worley et al. | |
| 4,531,340 | A | | 7/1985 | Sauer | |
| 4,554,718 | A | * | 11/1985 | Ollinger et al. | 52/506.07 |
| 4,713,919 | A | | 12/1987 | Platt | |
| 5,979,055 | A | | 11/1999 | Sauer et al. | |
| 6,115,986 | A | * | 9/2000 | Kelly | 52/731.9 |
| 6,205,733 | B1 | | 3/2001 | LaLonde | |
| 6,722,098 | B2 | * | 4/2004 | Platt | 52/733.1 |
| 7,240,460 | B2 | * | 7/2007 | Platt | 52/506.07 |
| 2006/0101763 | A1 | * | 5/2006 | Dohren | 52/506.07 |

OTHER PUBLICATIONS

European Patent Office Communication dated Apr. 9, 2009, Accompanied by Extended European Search Report and Search Opinion, Issued in European Patent Application No. 07013143.8, and copies of the European Patents Listed in the European Search Report.

* cited by examiner

FIG.1
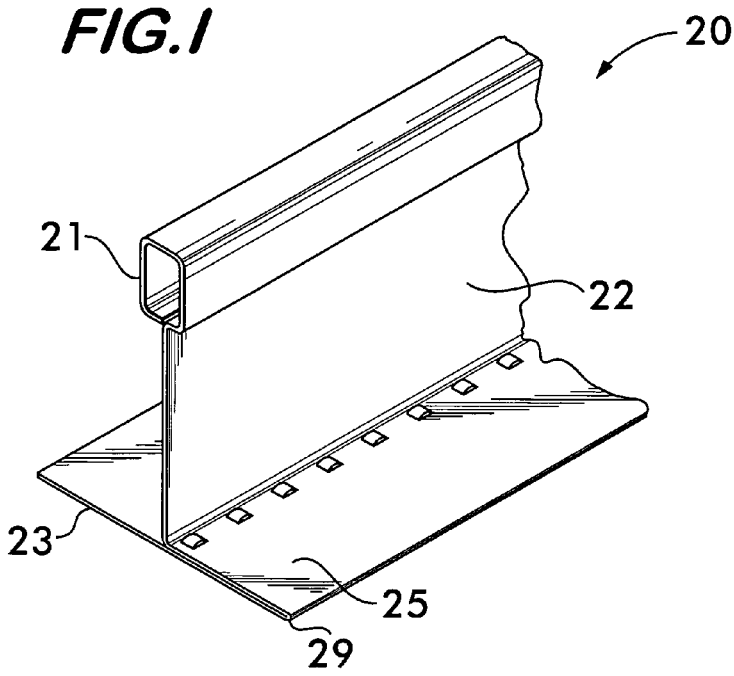
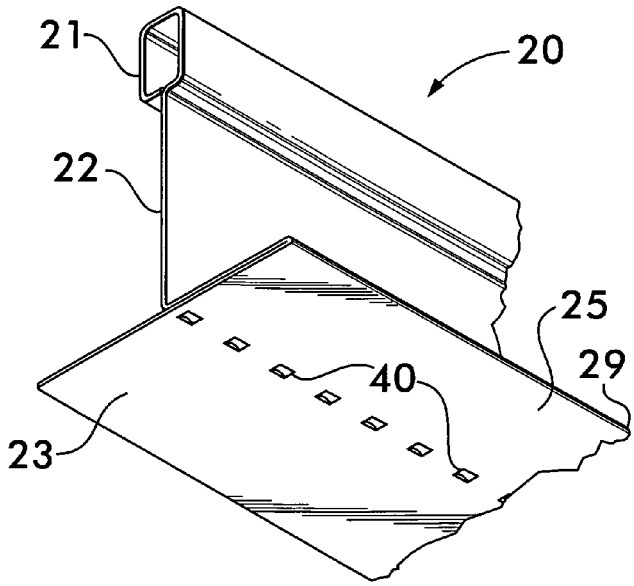
FIG.2

FIG. 6
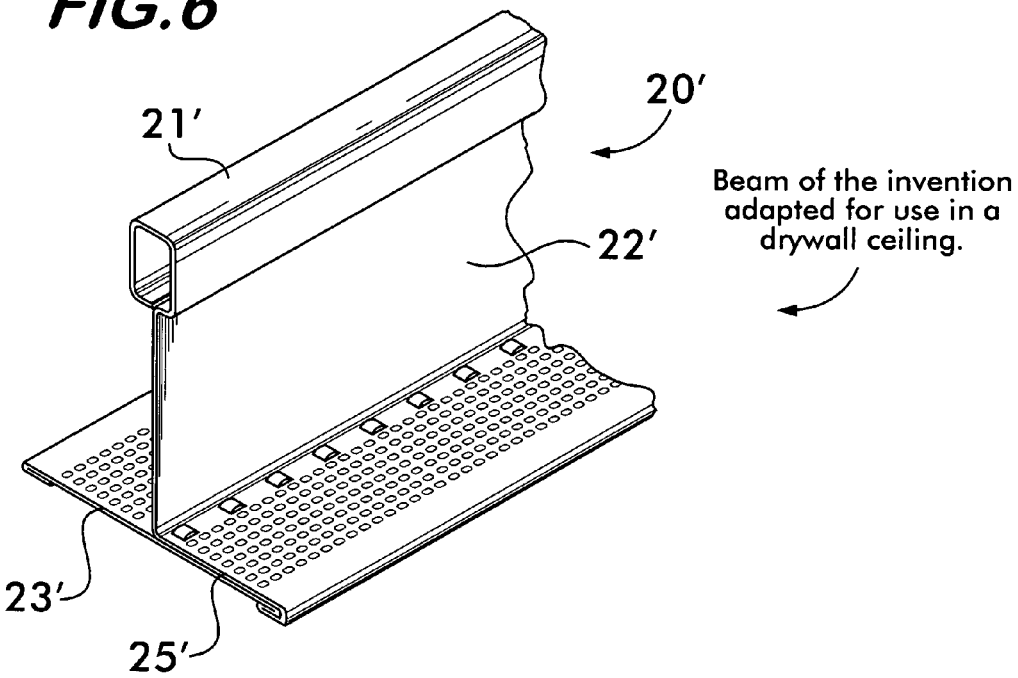
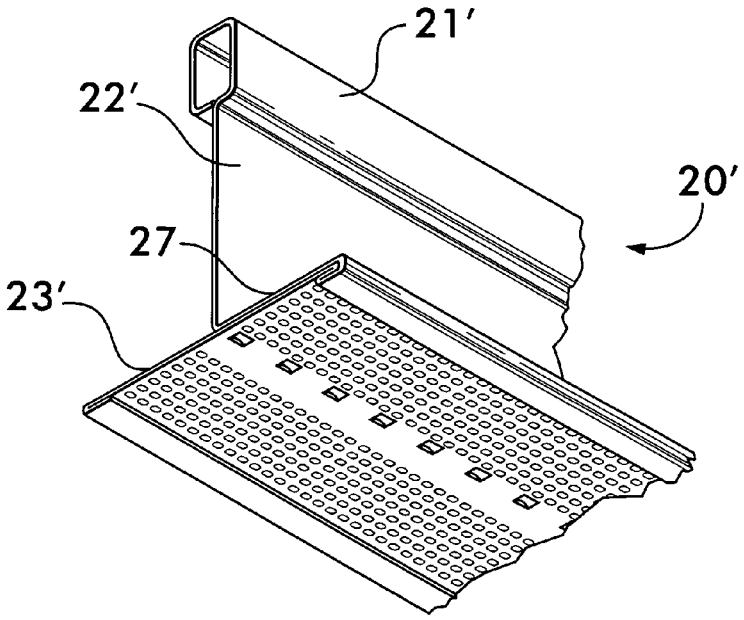
FIG. 7

FIG.8
(PRIOR ART)
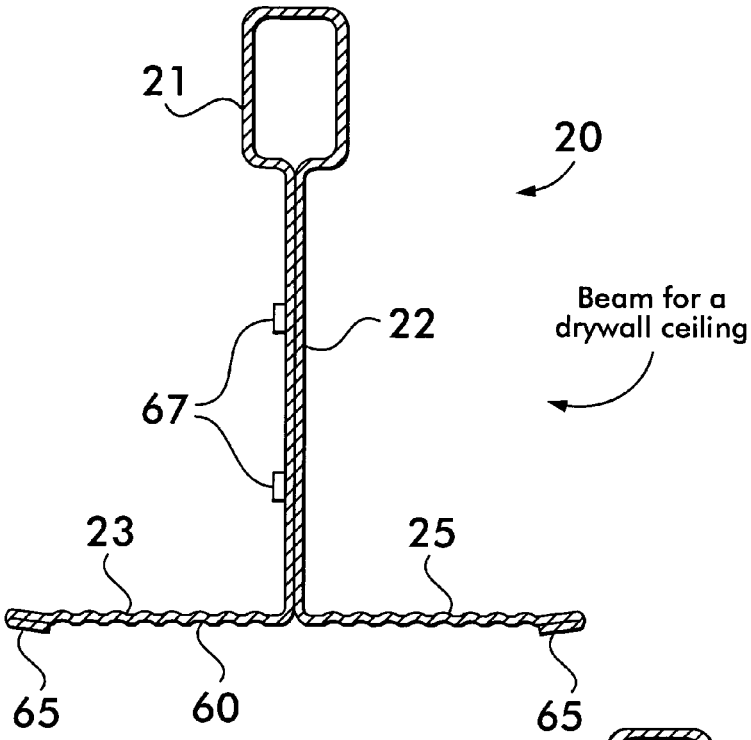
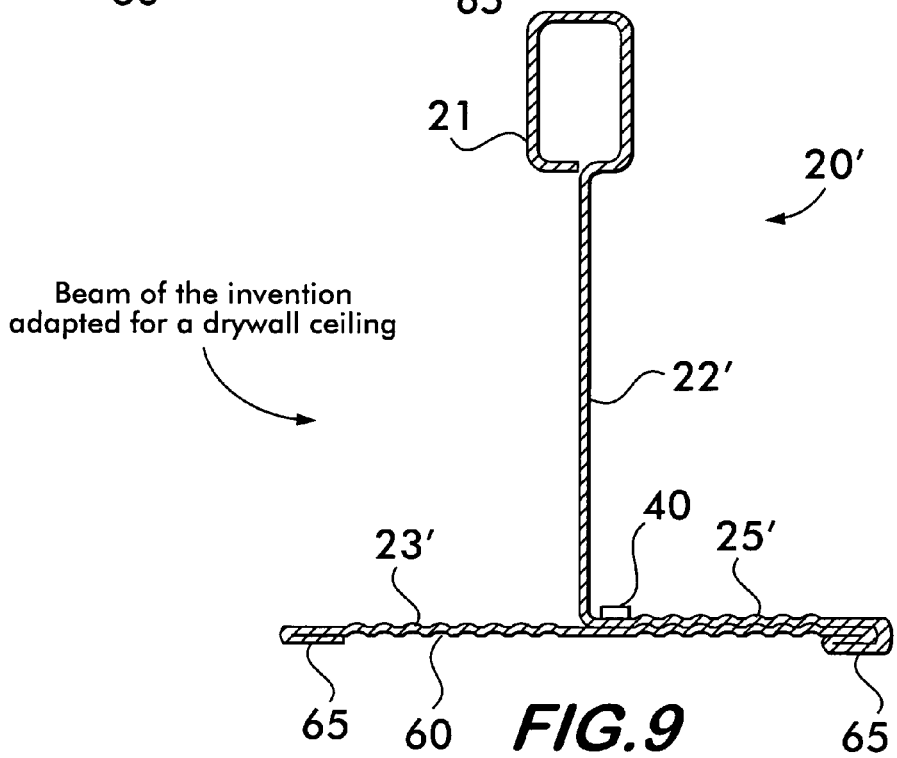
FIG.9

SINGLE LAYERED WEB BEAM FOR A DRYWALL SUSPENDED CEILING

This application is a continuation-in-part of application Ser. No. 11/446,729, filed Jun. 5, 2006, for Single-Layered Web Beam For A Suspended Ceiling.

BACKGROUND OF THE INVENTION

1. Field of the Invention

This invention relates to beams that form a grid in a suspended ceiling that has drywall sheets attached to flanges in the beams.

2. Description of the Related Art

Beams used in grids for suspended ceilings of either the panel or drywall type are well known. Such beams, which are similar for both types of ceilings, have an inverted T cross section formed by continuously passing a strip of metal through rollers that fold the strip longitudinally.

The beams carry a vertical load on the flanges only. To avoid twisting and bending in tee beams under such vertical load on the flanges in suspended ceilings, beams symmetrical in cross section are used, so that the beam is loaded in the plane of the web. In the prior art, this is done with a double-layered web, having a flange cantilevered from each layer of the web, wherein the flanges oppose one another horizontally.

Beams with a single-layered web have been tried, in an attempt to produce a beam that uses less metal. In such a beam that has a single-layered web, only a single flange is cantilevered from the web. An opposing flange is cantilevered from the first formed flange. Such a beam is unbalanced under a vertical load on both flanges, and is subject to twisting and bending, since it is not loaded in the plane of the web.

In U.S. Pat. Re 31,528, incorporated herein by reference, such problems with single-layered webs are discussed with reference to FIG. 7 of the patent.

In U.S. Pat. No. 4,520,609, attempts were made to balance the cross section of a single-layered web beam by adding more material to the top and bottom of the beam on opposite sides of the web.

In U.S. Pat. No. 4,713,919, a beam having a web with a full first layer, and a partial second layer, is disclosed.

In U.S. Pat. No. 5,979,055, incorporated herein by reference, a beam having a web that is formed partially of one layer, is pieced together.

Such prior art beams with a full, or partial, single-layered web were unbalanced and lacked the necessary strength and stiffness to support the loads, unless more and heavier material was used than in a double-layered web beam. This defeated the desire to use a single-layered web beam with its promise of the use of less metal to make the beam. Virtually all beams for suspended ceilings continue to have a double-layered web.

BRIEF SUMMARY OF THE INVENTION

In parent U.S. patent application Ser. No. 11/446,729, of which this application is a continuation-in-part, there is disclosed a balanced beam for a suspended ceiling formed with a single-layered web that has one flange bent and cantilevered from the bottom of the web, and a second, opposite flange, that is cantilevered from close to the web by a seam that secures the first and second flanges together close to the web.

The seam is preferably formed by continuous stitching as the beam is being rollformed, as seen, for instance, in the '055 patent. Other forms of binding, such as spot, or continuous, welding, as well as adhesives, may be used to form the seam.

Such a beam in cross section is balanced, and acts to load the beam in the plane of the web, so that any twisting or bending in a beam having a single-layered web is substantially eliminated.

The seam also binds the flanges themselves together to produce a bottom member at the base of the single-layered web that stiffens the web itself.

Such a single-layered web beam with a seam in the flanges along the web that binds the flanges together near the bottom of web, so that both flanges are cantilevered from the web, provides the equivalent strength and rigidity of a double-layered web formed of the same thickness of strip metal, but without using a second layer of the metal in the web, so there is less metal needed to make the beam.

The present invention is directed to such a single-layered web beam adapted for use in a drywall suspended ceiling.

BRIEF DESCRIPTION OF THE SEVERAL VIEWS OF THE DRAWING

FIG. 1 is a partial perspective view of the basic single-layered web beam of the invention, taken from above.

FIG. 2 is a partial perspective view of the beam of FIG. 1, taken from below.

FIG. 6 is a view similar to FIG. 1 showing a single-layered web beam adapted for use in a drywall suspended ceiling.

FIG. 7 is the beam of FIG. 6 shown in a partial perspective view from below, similar to the view in FIG. 2.

FIG. 8 is a cross sectional view of a prior art beam used in a drywall ceiling.

FIG. 9 is a cross sectional view of the beam of the invention adapted for use in a drywall suspended ceiling.

DETAILED DESCRIPTION OF THE INVENTION

Beams 20 for suspended ceilings are shown in FIGS. 1 through 5. Such beams include the prior art beams shown in FIGS. 3 and 4, and the single-layered web beam of the invention shown in FIGS. 1, 2, and 5. Beams 20 have a bulb 21 at the top of a web 22. Opposing flanges 23 and 25 extend horizontally away from the web at the bottom of the beam.

Figure 3:
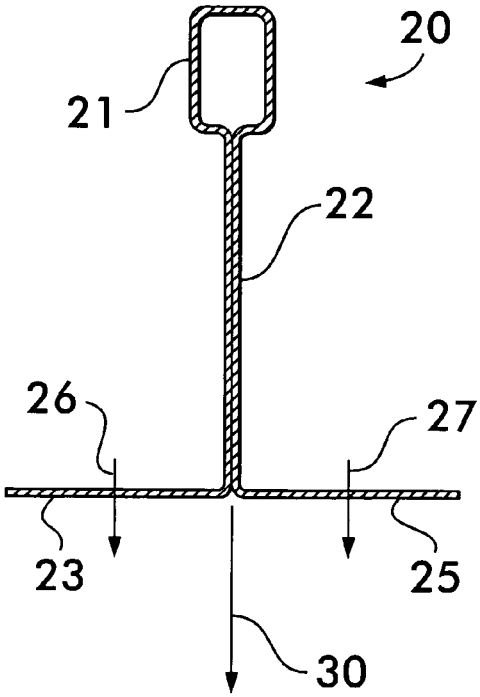
FIG.3 (PRIOR ART)
FIG. 3 is a cross sectional view of a prior art beam with a double-layered web.
Figure 4:
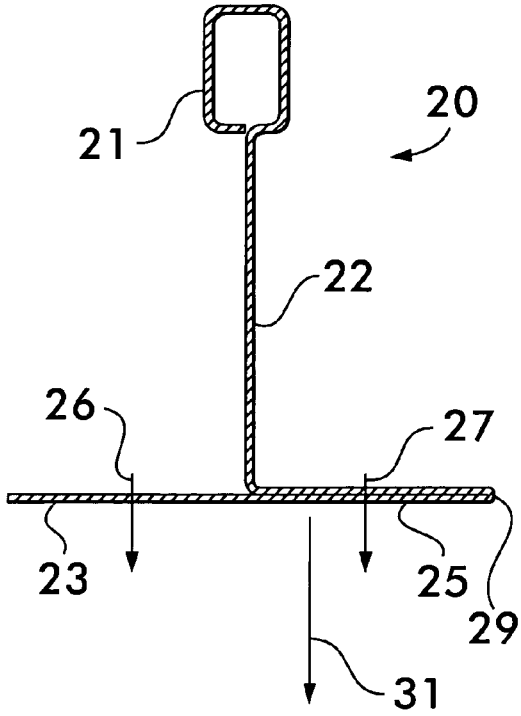
FIG.4 (PRIOR ART)
FIG. 4 is a cross sectional view of a prior art beam with a single-layered web.
Figure 5:
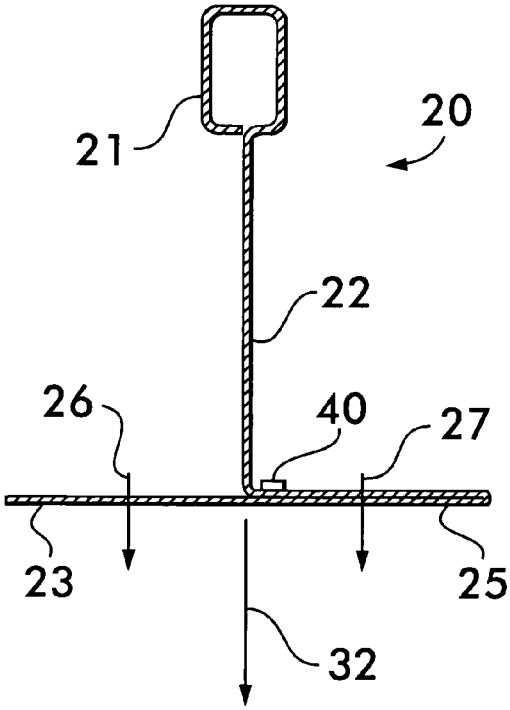
FIG. 5 is a cross sectional view of the beam of FIGS. 1 and 2.

The vertical panel load, or vertical drywall load, on the beams in a suspended ceiling, is indicated in FIGS. 3 through 5 by vectors that represent the amount, location, and direction of the load exerted by the panels or drywall in a suspended ceiling. The load on each flange is indicated by vectors 26 and 27 on the prior art beams shown in FIGS. 3 and 4, and on the beam of the invention shown in FIG. 5.

The prior art beam 20 shown in FIG. 3 has a two-layered web 22, with each of the flanges 23 and 25 cantilevered from one of the layers of the web 22. The beam is symmetrical, and hence balanced, in cross section.

The prior art beam 20 shown in FIG. 4 has a single-layered web 22 with a flange 25 cantilevered from the bottom of the web 22, to the right, and then a second opposing flange 23 cantilevered from flange 25 at location 29, in a direction to the left.

The basic single-layered web beam 20 of the invention, as seen in FIGS. 1, 2, and 5, has a single-layered web 22, with the flanges formed as in the prior art beam 20 of FIG. 4. The basic single-layered web beam 20 of the invention as seen for instance in FIGS. 1, 2, and 5, also has a seam 40 that runs longitudinally along the web 22 of the beam, that binds flanges 23 and 25 together, so that flange 23 is cantilevered from flange 25 along web 22.

The seam 40 is preferably made as the beam is being continuously rollformed, as by stitching. A form of stitching is disclosed in U.S patent '055 cited above. A seam 40 could also be formed by continuous or spot welding, or by adhesives.

Seam 40, in effect, cantilevers the flange 23 from the single-layered web 22 of the basic beam 20 of the invention as seen for instance in FIGS. 1, 2, and 5, so that the result is a balanced beam that is loaded through the plane of the single-layered web 22. Such basic beam 20 of the invention resists twisting and bending to an extent equivalent to that of a prior art double-layered web beam of a comparable size made of the same thickness metal strip, as seen for instance in FIG. 3. The beam of the invention however, uses less metal.

In FIGS. 3, 4, and 5 of the drawings, the loading of the beams 20, both prior art and of the invention, is shown through the use of vectors.

In FIG. 3, load vectors 26 and 27 represent the vertical loading on each of the flanges 23 and 25 of a double-layered prior art beam 20, in either a panel or drywall suspended ceiling. The resultant load vector 30 of vectors 26 and 27 of such prior art double-layered web beam passes through the plane of web 22, since the beam is balanced. Such balanced beam creates a maximum resistance to bending and twisting.

In FIG. 4, there is shown the single-layered beam of the prior art. Again, as in FIG. 3, the vectors 26 and 27 represent the loads applied to the beams, either through panel, or drywall, loads. However, because of the beam construction wherein flange 23 is cantilevered from flange 25 at location 29, the resultant load vector 31 is shown applied at a distance away from the single-layered web, resulting in an unbalanced beam subject to bending and twisting that is not present in the balanced beam of FIG. 3.

In FIG. 5, which shows the basic single-layered web beam 20 of the invention, again, as in the prior art, the beam 20 is vertically loaded on the flanges 23 and 25, in the suspended ceiling, as shown by vectors 26 and 27. However, seam 40 binds flange 23 to flange 27 along web 22, so that in effect both flanges 23 and 25 are cantilevered from web 22, resulting in a balanced beam. Load resultant 32 passes through the plane of the web 22, so that the single-layered basic beam 20 of the invention resists twisting and bending equivalent to a comparably sized two-layered web beam 20, as seen in FIG. 3, but with the use of less metal.

Figure 10:
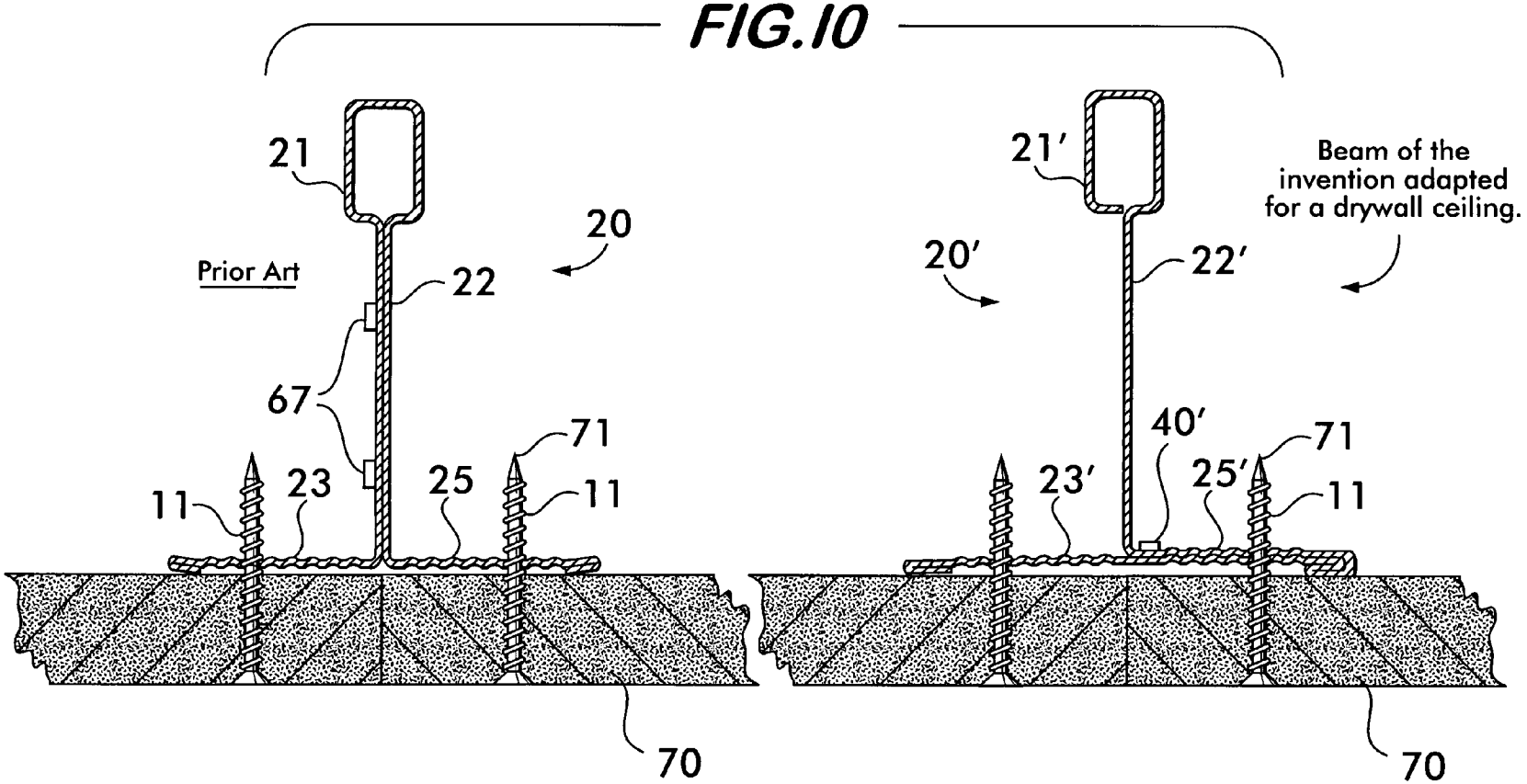
FIG. 10 is a partial cross sectional view of a suspended drywall ceiling, showing the prior art beam of FIG. 8, and the single-layered web beam of the invention adapted for use in a drywall suspended ceiling, having attached drywall sheets.

There is shown in FIGS. 8 and 10, for use in a drywall suspended ceiling, a prior art two-layered beam, as disclosed in U.S. Pat. No. 6,722,098, incorporated herein by reference.

There is shown in FIGS. 6, 7, 9, and 10, the basic single-layered web beam of the invention adapted for use in a drywall suspended ceiling. Such beam is designated 20'.

Both the prior art beam 20 as shown for instance in FIGS. 8 and 10, and the beam 20' of the invention adapted for drywall in FIGS. 6, 7, 9, and 10, have a bulb 21 or 21', a web 22 or 22', and opposing flanges 23 and 25 or 23' and 25'.

The prior art two-layered web beam 20 of FIG. 8 is stitched together at 67, longitudinally of the web 22, as described in detail in the '098 patent. In such prior art beam, hems 65 serve to retain the point 71 of self-tapping screws 11 in contact with an indent 60 in the flanges 23 and 25 of the beam 20, whereby the screw 11 can pierce the flanges and secure the drywall sheet 70 to the flanges 23' and 25'.

In the basic single-layered web beam of the invention 20' adapted for drywall suspended ceilings, as seen in FIGS. 6, 7, 9, and 10, hems 65 are formed in the single-layered flange 23' extending to the left from the web 22', as seen in such Figures, and in the double-layered flange 25' extending to the right from the web 22', as also seen in such Figures.

The drywall sheets 70, when secured to the flanges 23 and 25 of the prior art double-layered web beam 20 as seen on the left in FIG. 10, exert a vertical downward load, as shown by vectors 23 and 25 in FIG. 3. The drywall sheets 70, when secured to the flanges 23' and 25' of the basic single-layered web beam 20' of the invention adapted for drywall, as seen in FIG. 10, also exert a vertical downward load, as seen in FIG. 5.

As discussed above, the prior art double-layered web beam 20 is symmetrical, and balanced, and, as seen in FIG. 3, the total load 30 on the beam, which is the sum of the loads exerted on each flange, passes through the plane of the web 22, with a minimum of bending and twisting on the beam 20.

The beam 20' of the invention adapted for a drywall suspended ceiling likewise is balanced, as explained above, and shown in the drawings, since the seam 40 along the web acts to cantilever both flanges 23' and 25' from the web 22', so that the total load 32, as seen in FIG. 5, passes through the plane of the single-layered web 22'. Since the load is balanced in the basic single-layered web beam 20' of the invention as adapted for drywall, there is a minimum of twisting and bending on the beam 20' from the downward loads of the drywall sheets 70.

There is a savings in metal with the basic single-layered web balanced beam of the invention for a drywall suspended ceiling 20' over a comparable sized prior art balanced double-layered web beam 20 as seen in FIGS. 8 and 10.

What is claimed is:

1. In a beam for a grid that supports drywall ceiling sheets in a suspended ceiling, formed from a single layer of metal folded longitudinally into a cross section having (a) a bulb at the top, (b) a single-layered web extending downwardly from the bulb, (c) a first and second flange at the bottom of the web, each of which extends horizontally on the opposite side of the web from the other flange, with the first flange formed of an upper and lower layer of metal, the upper layer of which extends from the bottom of the web, and the second flange formed of at least a single layer of metal extending from the lower layer of the first flange;

(d) downwardly extending hems that reinforce the flanges, and (e) upward indentations on the bottom of each flange that receive and anchor self-tapping screws that secure drywall sheets to the beams;

the improvement comprising a balanced beam for a drywall suspended ceiling wherein the second flange is cantilevered from the bottom of the web by a binding, so that the resultant load of an equal vertical load on each of the first and second flanges from the drywall sheets attached to each of the flanges of the beam passes directly through the vertical plane of the web.

2. The beam of claim 1, wherein the binding is formed by a seam of stitches.

3. The beam of claim 1, wherein the binding stiffens the web.

* * * * *